US005930965A

United States Patent [19]

Carver

[11] Patent Number: 5,930,965

[45] Date of Patent: Aug. 3, 1999

[54] INSULATED DECK STRUCTURE

[76] Inventor: Tommy Lee Carver, 1754 Wildwood Dr., Charlotte, N.C. 28214

[21] Appl. No.: 08/935,780

[22] Filed: Sep. 23, 1997

[51] Int. Cl.[6] ..... E04B 5/00; E04B 5/18

[52] U.S. Cl. ..... 52/320; 52/322; 52/324; 52/326; 52/330; 52/309.12; 52/309.17; 52/332; 52/338; 52/405.1; 52/742.14; 52/745.05; 264/31; 264/35

[58] Field of Search ..... 52/309.12, 309.17, 52/320, 330, 332, 335, 338, 405.1, 742.14, 745.05, 322, 324, 326; 264/31, 35

[56] References Cited

U.S. PATENT DOCUMENTS

| | | | |
|---|---|---|---|
| 716,628 | 12/1902 | Dickey . | |
| 1,183,594 | 5/1916 | Robinson . | |
| 1,773,168 | 8/1930 | Brostrom | 52/332 |
| 2,174,581 | 10/1939 | Hoge | 52/338 |
| 2,356,138 | 8/1944 | Widmayer | 52/342 X |
| 3,203,146 | 8/1965 | Carter . | |
| 3,241,275 | 3/1966 | Bomhardt et al. . | |
| 3,320,704 | 5/1967 | Forsythe et al. . | |
| 3,579,937 | 5/1971 | Lukens . | |
| 3,918,230 | 11/1975 | Carroll . | |
| 3,962,841 | 6/1976 | Carroll . | |
| 3,965,633 | 6/1976 | Carroll . | |
| 3,965,641 | 6/1976 | Carroll . | |
| 4,048,777 | 9/1977 | Carroll . | |
| 4,090,336 | 5/1978 | Carroll . | |
| 4,114,335 | 9/1978 | Carroll . | |
| 4,120,131 | 10/1978 | Carroll . | |
| 4,267,678 | 5/1981 | Carroll . | |
| 4,274,239 | 6/1981 | Carroll . | |
| 4,394,807 | 7/1983 | Carroll . | |
| 4,507,901 | 4/1985 | Carroll . | |
| 5,561,957 | 10/1996 | Gauthier | 52/332 |

FOREIGN PATENT DOCUMENTS

| | | | |
|---|---|---|---|
| 742721 | 3/1933 | France | 52/338 |
| 2042616 | 9/1980 | United Kingdom | 52/324 |

*Primary Examiner*—Robert Canfield
*Attorney, Agent, or Firm*—Alston & Bird LLP

[57] ABSTRACT

There is provided a self-supporting insulated deck structure for buildings whereby the deck can be constructed inexpensively and efficiently and can attain a desirable fire rating in addition to improved sound absorption properties. The self-supporting insulated deck structure is made of a cementitious material and has no exposed structural steel members. Formwork for the insulated deck structure is made of integral panels formed from foam insulation members, fire retarding boards, and sound attenuating boards. The integral panels are supported on shored steel support brackets. Once the cementitious material cures, the shoring is removed as the deck structure is self-supporting. The adjacent integral panels provide the insulated deck structure with desirable fire rating and sound absorption properties.

25 Claims, 2 Drawing Sheets

INSULATED DECK STRUCTURE

FIELD OF THE INVENTION

The present invention relates to construction materials and methods, and more particularly, relates to insulated concrete deck structures of the type which form floors of buildings.

BACKGROUND OF THE INVENTION

Conventional concrete floors are common in nonresidential buildings and multi-family residential buildings including both structural steel buildings and masonry wall buildings. These buildings include office buildings, nursing homes, schools, apartments, and any other buildings having above-ground floors which span extended lengths.

With a conventional concrete floor system, the building is comprised of structural steel support beams and steel floor joists. The structural steel beams provide support for the steel floor joists and the steel floor joists span the distance between the steel support beams. A metal deck is placed on top of the steel floor joists and becomes the form support for the concrete floor. Reinforcement bar and wire mesh may be placed on top of the metal deck to provide additional structural strength to the concrete. Next, wet concrete is poured on top of the metal deck and allowed to harden thereby forming a concrete slab. The depth of the concrete slab is typically a minimum of four inches.

Most buildings will require a minimum fire rating which indicates a certain resistance to fire damage. In conventional systems, the steel floor joists, which provide the structural strength to support the concrete slab, remain exposed to the floor below. Hence, a subsequent fire retarding material must be applied, or an appropriate ceiling board constructed, to protect the exposed steel floor joists. Conventional concrete slabs also provide limited insulation and sound attenuation properties. Additionally, any formwork used when pouring the concrete, other than the metal deck, must be removed, which can be labor intensive and can result in higher costs being associated with the construction of these types of concrete slabs.

In seeking better materials for constructing floors of a building, several forms of insulated deck structures have been suggested. One such example of a deck structure is disclosed in U.S. Pat. No. 4,090,336 to Carroll which discloses an insulated floor and roof deck structure. The structure has a plurality of sub-purlins supported on structural members. Gypsum formboard and synthetic organic polymer foam are prepared in panels and supported on the flanges of the sub-purlins. Following installation of the gypsum formboard and polymer foam assembly, concrete is poured to a suitable thickness to form a unitary structure. The concrete flows around the sub-purlins and comes into contact with the gypsum coreboard and, after the concrete dries, a composite structure which provides resistance to deflections is formed. The top of the sub-purlin extends above the top surface of the foam and is very close to the upper surface of the concrete poured thereover. Thus, as taught by the patent, the sub-purlin is an integral structural part of the deck structure and provides structural strength to support loads which could not be supported by the concrete alone. Because the sub-purlins are exposed and provide structural support to the deck structure, steps must be taken to fireproof the sub-purlins so that a desired fire rating can be attained.

In U.S. Pat. No. 716,628 to Dickey a fireproof flooring is disclosed which includes steel floor beams supporting a series of previously molded concrete slabs bridging the space between the beams. A core of loose cinders is shoveled onto the slabs so as to largely fill the space between the beams. A bed of concrete is then applied over the cinders and into the recesses adjacent to the beams. Under modern fire codes, however, additional fire proofing would have to be installed over the beams to receive a certain fire rating.

U.S. Pat. No. 3,320,704 to Forsythe, et al. discloses a roof deck including a series of sub-purlins welded to the top of a series of I-beam purlins to form a grid. The sub-purlins are generally hollow and open from the top. Expanded metal lath strips are vertically positioned in the sub-purlins and extend through the slots therein. Wire mesh is supported on the cradles of lath strips and gypsum concrete fills the sub-purlins and extends through the slots. The gypsum concrete embeds the wire mesh and lath strips to form a monolithic structure. The concrete between the sub-purlins is supported by a plurality of removable form elements. The concrete is poured into the hollow box section of the sub-purlins to provide a composite member for the roof deck structure. The roof structure according to this patent would also require additional fire proofing and insulation.

Thus, there is a need for improved building materials for use in the construction of insulated deck structures. Such a deck structure must be capable of being efficiently installed to reduce labor costs while at the same time providing adequate insulation properties and sound attenuation. In particular, such a deck structure should be able to achieve a certain desired fire rating without the necessity of additional fireproofing procedures or materials.

SUMMARY OF THE INVENTION

The present invention provides an insulated deck structure for buildings whereby the deck can be constructed inexpensively and efficiently and can attain a desirable fire rating. The structure according to the present invention advantageously includes a self-supporting deck structure without exposed structural steel members. The deck structure also includes support brackets which are embedded in the underside of a concrete slab for supporting insulation and other materials.

The deck structure is formed from a slab made of a cementitious material such as concrete. The slab has a substantially planar upper surface and a lower surface. The lower surface defines a plurality of downwardly depending beam members extending in parallel directions and a plurality of recessed surfaces therebetween which are substantially planar and horizontal. The beam members have a predetermined depth below the recessed surfaces and are otherwise dimensioned to provide structural strength sufficient to support the deck structure and any design loads placed thereon.

A foam insulation member is positioned between each adjacent pair of beam members, adjacent to the respective recessed surface. The foam insulation members have planar and horizontal upper surfaces corresponding to the recessed surfaces. A fire retardant board is provided below each of the foam insulation members.

The support brackets are each affixed to the underside of a corresponding downwardly depending beam members. The support bracket has an upwardly extending portion secured within the downwardly depending beam member and a pair of generally horizontally extending portions for supporting the fire retardant board and the foam insulation member. The upwardly extending portion extends into the downward end of the beam member by a distance less than the depth of the beam member to a horizontal level below the upper surface of the foam insulation member. In particular, the upwardly extending portion preferably extends to a height less than half of the depth of the foam members. Although preferably formed of steel, the support brackets are configured to be non-load bearing members and thus do not require subsequent fireproofing for the deck structure to receive a certain fire rating.

In an alternate embodiment, a plurality of horizontal reinforcing members can be advantageously positioned such that the horizontal reinforcing members are generally parallel to the support brackets. A first horizontal reinforcing member is in close proximity to the upper end of the upwardly extending portion of each of the support brackets. A second horizontal reinforcing member is disposed a predetermined vertical distance above the first horizontal reinforcing member. A plurality of vertical reinforcing members are connected to the first and second horizontal reinforcing members and extend upwardly a distance beyond the second horizontal reinforcing member. A third and a fourth horizontal reinforcing member are connected to opposite sides of the vertically extending members a distance above the second horizontal reinforcing member. A lateral support member extending laterally between adjacent foam insulation members can advantageously be positioned adjacent and perpendicular to the third and the fourth horizontal members. The vertical and horizontal reinforcing members are thus secured within the downwardly depending beam member.

In addition, a reinforcing wire mesh can be advantageously positioned adjacent to the respective recessed surface between the foam insulation member and each adjacent pair of beam members prior to pouring the concrete so that the wire mesh is embedded in the slab. Advantageously, a sound attenuation board can be provided below each of the fire retardant boards. A finishing member, such as conventional drywall, can be connected to at least one of the pair of generally horizontally extending portions of the support brackets. Associated methods also form a part of the invention.

As such, there has been provided an insulated deck structure allowing for the efficient construction in terms of both labor and cost of the floor or roof of a building. The insulated deck structure provides sufficient structural strength with improved fire retardation in addition to improved insulation and sound attenuation values.

BRIEF DESCRIPTION OF THE DRAWINGS

The foregoing and other advantages and features of the invention, and the manner in which the same are accomplished, will become more readily apparent upon consideration of the following detailed description of the invention taken in conjunction with the accompanying drawings, which illustrate preferred and exemplary embodiments, and wherein.

DETAILED DESCRIPTION OF THE PREFERRED EMBODIMENTS

The present invention will now be described more fully hereinafter with reference to the accompanying drawings, in which preferred embodiments of the invention are shown. This invention may, however, be embodied in many different forms and should not be construed as limited to the embodiments set forth herein; rather, these embodiments are provided so that this disclosure will be thorough and complete and will fully convey the scope of the invention to those skilled in the art. Like numbers refer to like elements throughout.

Figure 1:
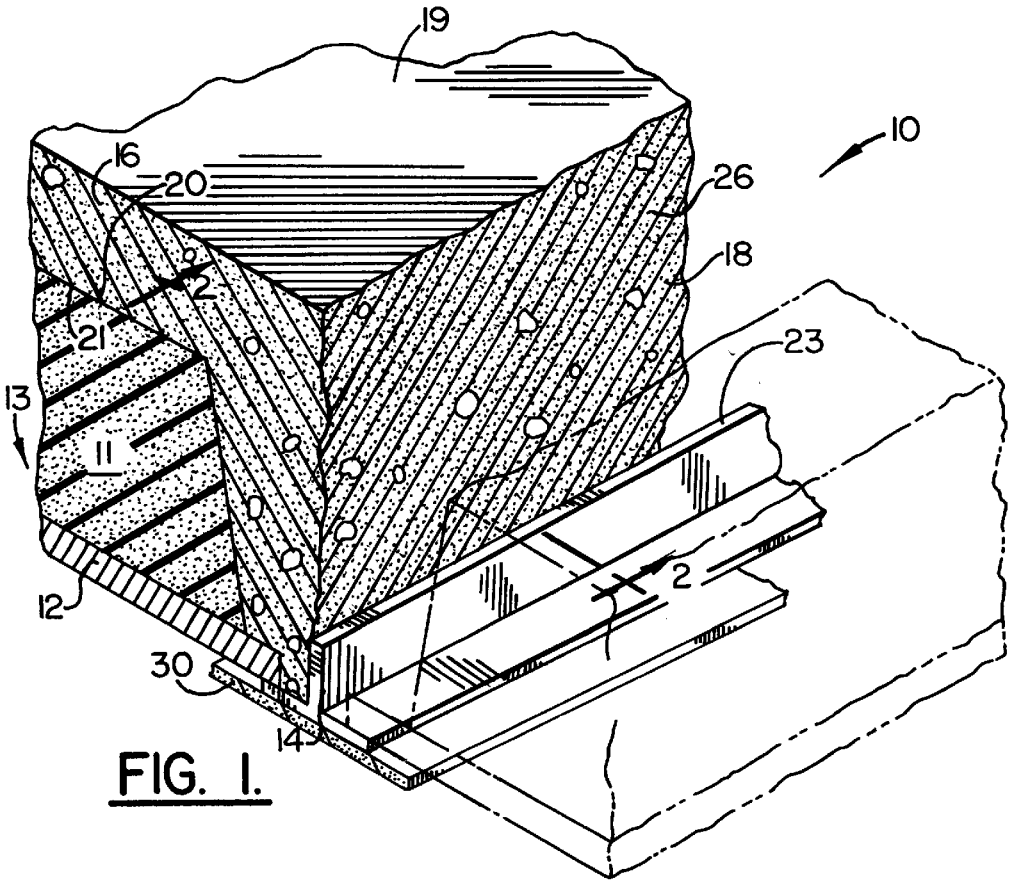
FIG. 1 is a perspective view illustrating an embodiment of an insulated deck structure.
Figure 4:
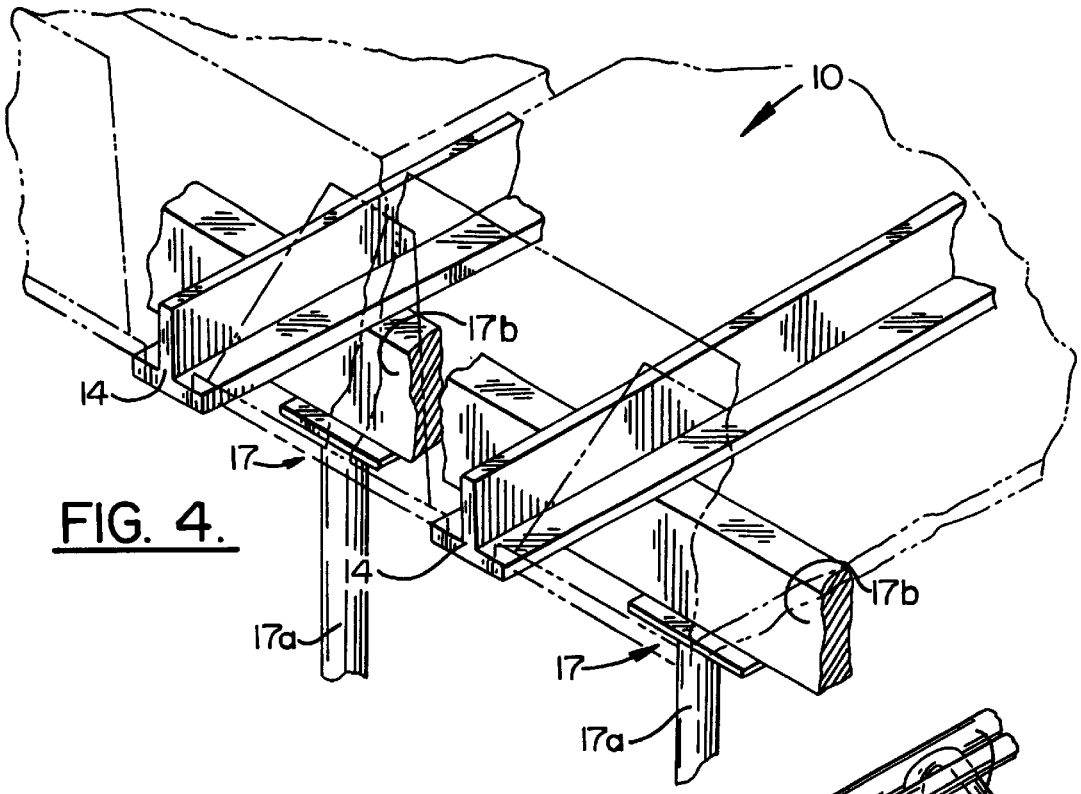
FIG. 4 is a perspective view illustrating the shoring of the support brackets of the insulated deck structure according to the present invention.

Referring now to the drawings, and in particular to FIG. 1, where there is shown a self-supporting insulated deck structure 10 according to the present invention. As discussed more fully hereinbelow, the formwork of the insulated deck structure includes a foam insulation member 11 laminated to a fire retardant board 12 to form an integral panel 13. Adjacent integral panels 13 are supported on pairs of support brackets 14 by means of generally horizontally extending portions 15. As shown in FIG. 4, before the cementitious material of the slab 16 is poured, the support brackets 14 are shored using shoring members 17*a,b* as is well known in the art. The shoring members 17 may include scaffolding 17*a* in combination with wood studs 17*b*. The shoring members 17*a* extend upwards from the structure below the insulated deck structure 10 to the support brackets 14.

Referring again to FIG. 1, the integral panels 13 as supported by the support brackets 14 provide the entire formwork for the insulated deck structure 10. After the cementitious material of the insulated deck structure 10 has cured, the shoring members 17 are removed. The support brackets 14 are embedded in the underside of the downwardly depending beam members 18, providing support for the formwork only and not the insulated deck structure. As such, the deck structure 10 is self-supporting.

Figure 2:
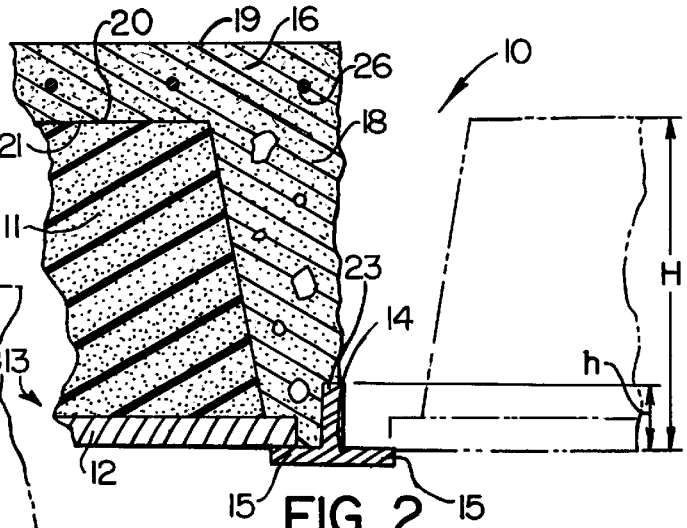
FIG. 2 is a cross section of the insulated deck structure of FIG. 1 taken along lines 2—2.

As shown in FIGS. 1 and 2, the self-supporting insulated deck structure 10 is formed from a slab 16 made of a cementitious material such as light-weight concrete, preferably of a compressive strength of at least 4000 psi. The slab 16 includes a substantially planar upper surface 19 and a lower surface 20 defining a plurality of downwardly depending beam members 18 extending in parallel directions with a plurality of recessed surfaces 21 therebetween which are substantially planar and horizontal. The slab 16 preferably has a thickness of at least two inches between the upper surface 19 and the recessed surfaces 21 defined by the downwardly depending beam members 18. However, the thickness of the slab 16 may vary depending on the horizontal span of the self-supporting insulated deck structure 10 and the intended design loads. The thickness of conventional concrete floors is typically four inches requiring more concrete and approximately thirty percent more time in placing and finishing the floor. The downwardly depending beam members 18 of the slab 16 have a predetermined depth, preferably 8 to 24 inches, below the recessed surfaces 21. The width of the downwardly depending beam members 18 may be tapered from top to bottom, preferably being six inches at the top and three inches at the bottom.

As further shown in FIGS. 1 and 2, and as noted above, the formwork of the self-supporting insulated deck structure 10 includes foam insulation members 11 positioned between each adjacent pair of downwardly depending beam members 18 and adjacent to the respective recessed surfaces 21. The foam insulation members 11 are preferably formed of an expanded polystyrene with a height preferably in the range of 8 to 24 inches. As discussed above, the foam insulation members 11 provide the formwork for the lower surface 20 of the slab 16. Thus, the lateral surfaces of each of the foam insulation members 11 may be tapered from bottom to top in order to taper the flanking of the downwardly depending beam members 18. Preferably, the width of the foam insulation members 11, when tapered as described above, is such that the space between adjacent foam insulation members is three inches at the base and six inches at the top.

Advantageously, as shown in FIGS. 1 and 2, the formwork of the self-supporting insulated deck structure 10 further includes a fire retardant board 12 laminated to the lower surface of each of the foam insulation members 11 to form an integral panel 13. Preferably, the fire retardant board 12 may be one inch thick gypsum board. The width of the fire retardant board 12 may be slightly greater than the width of the foam insulation member 11, preferably, by approximately 1.5 inches on each side. As such, the foam insulation member 11 is supported on the fire retardant board 12 which is in turn supported on the generally horizontally extending portions 15 of the support brackets 14.

Figure 5:
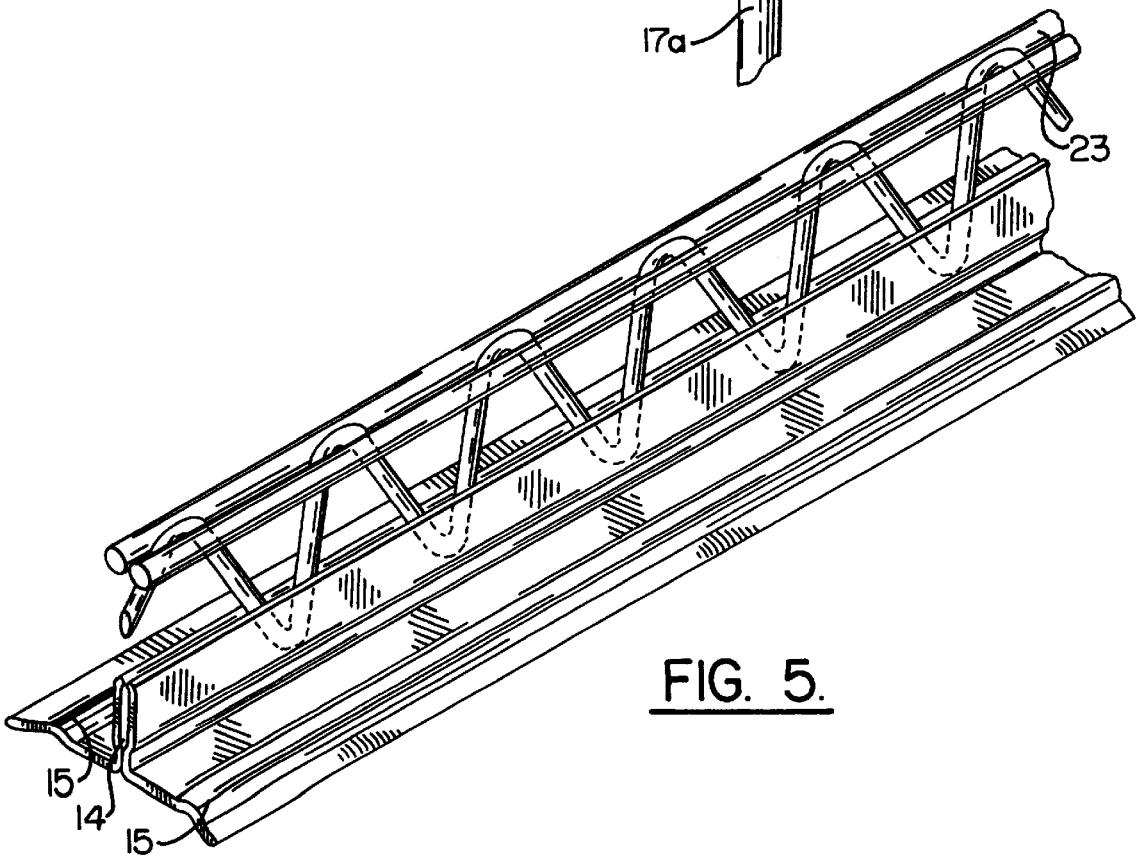
FIG. 5 is a perspective view of an alternate embodiment of a support bracket.

As shown in FIGS. 1 and 2, the support brackets 14 are preferably a bulb tee type truss as shown in FIG. 1, in the range of 1.5 to 3.5 inches in height and 3 inches wide. An alternate embodiment of a support bracket 14 is shown in FIG. 5. As noted above, the support brackets 14 are each affixed to the underside of a corresponding downwardly depending beam member 18 through an upwardly extending portion 23 secured within the downwardly depending beam member. As shown in FIG. 2, the upwardly extending portion 23 extends into the underside of the corresponding downwardly depending beam member 18 by a distance, h, which is considerably less than the depth of the downwardly depending beam member, H, to a horizontal level below the upper surface of the foam insulation members 11. In particular, the upwardly extending portion 23 preferably extends to a height less than half of the depth of the foam insulation members 11.

To form the self-supporting insulated deck structure 10, wet concrete is poured over the integral panels 13 and the support brackets 14, to a predetermined depth, which as noted above, may preferably be two inches above the top of the foam insulation members 11. Significantly, the self-supporting insulated deck structure 10 is formed without the use of any removable form material and, as a result, no labor is required for removing or cleaning the forms. Moreover, all the components are lightweight and easy to handle in contrast to conventional construction methods which often require cranes or other lifting devices.

Notably, the support brackets 14 are supported by the self-supporting insulated deck structure 10, not the contrary, and thus are non-load bearing members. Inasmuch as fire codes are more stringent for load bearing members than for non-load bearing members, the support brackets 14 are not subject to the same fire code requirements as the exposed structural steel members of conventional concrete floors and thus, the subsequent fire proofing steps of conventional concrete floors can be avoided. In addition, the self-supporting insulated deck structure 10 is more resistant to fire damage because the fire retardant board 12 insulates the slab 16 and downwardly depending beam members 18. The self-supporting insulated deck structure 10 is particularly useful for horizontal spans of up to 40 feet and floor loadings with live-load designs of 60 lbs. per square foot to 250 lbs. per square foot.

Figure 3:
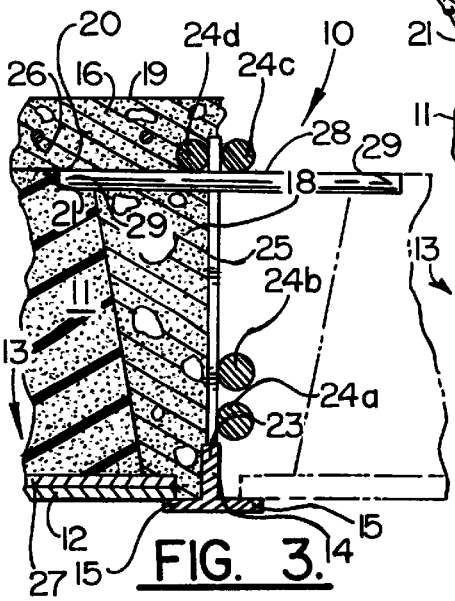
FIG. 3 is a partial cross section of an alternate embodiment of the insulated deck structure.

In an alternate embodiment of the self-supporting insulated deck structure 10 shown in FIG. 3, a plurality of vertical reinforcing members 25 extend upwardly from points along the upwardly extending portion 23 of the support bracket 24, to a position adjacent to the top of the foam insulation member 11. A plurality of horizontal reinforcing members 24 can advantageously be positioned generally parallel to the support bracket 14 and be connected to the vertical reinforcing members 25. A first horizontal reinforcing member 24*a* is in close proximity to the upper end of the upwardly extending portion 23 of each of the support brackets 14. A second horizontal reinforcing member 24*b* is positioned above the first horizontal reinforcing member 24*a* at a distance of approximately two inches. Third and fourth horizontal reinforcing members 24*c,d* are connected to the top of the vertical reinforcing members 25. One or more lateral support members 28 advantageously extend between opposing grooves 29 notched in the top surface of adjacent foam insulation members 11. The lateral support members 28 are disposed underneath and adjacent to the third and fourth horizontal reinforcing members 24*c,d* thus providing support for the vertical and horizontal reinforcing members.

Depending on the span required and anticipated floor loadings of the self-supporting insulated deck structure 10, the horizontal reinforcing members 24 are preferably #4 to #8 reinforcing bar. The vertical reinforcing members 25 are preferably #3 reinforcing bar and are connected to the horizontal reinforcing members 24 through conventional techniques, such as tack welding. Once the vertical reinforcing members 25 and the horizontal reinforcing members 24 are connected together, the reinforcing members are connected to the upwardly extending portion 23 of the support bracket 14 by tying the first horizontal reinforcing member 24*a* to the upwardly extending portion 23.

In an alternate embodiment, the vertical reinforcing members 25 of the self-supporting insulated deck structure 10 extend upwardly from the support bracket 14 to the second horizontal reinforcing member 24*b*. First and second horizontal reinforcing members 24*a,b* are positioned and connected to the vertical reinforcing members 25 as described above, however, the third and fourth horizontal reinforcing members 24*c,d* are omitted. It would be appreciated that other forms or sizes of reinforcement could be employed for other applications. The vertical reinforcing members 25 and the horizontal reinforcing members 24 are secured within the beam members 18 once the concrete has cured and are thus protected from fire exposure.

In another embodiment, also shown in FIG. 3, the self-supporting insulated deck structure may include a wire mesh 26 advantageously positioned above the upper surface of the foam insulation members 11 prior to the pouring of the concrete. The wire mesh 26 provides temperature reinforcement to minimize cracking in the surface of the concrete and will become embedded in the slab 16 as the concrete cures. Preferably, the wire mesh 26 will measure 6" by 6" and be comprised of #10 wire. The wire mesh 26 provides additional structural strength to the self-supporting insulated deck structure 10.

Advantageously, the combination of the fire retardant boards 12 and the foam insulation members 11 in the self-supporting insulated deck structure 10, provides increased sound absorption over conventional concrete floors. In another embodiment, also shown in FIG. 3, a panel of sound attenuating board 27, such as a tectum plank, preferably one inch thick, can be laminated to the underside of the fire retardant board 12 as part of the integral panel 13. The sound attenuation board 27 provides the self-supporting insulated deck structure 10 with even greater sound attenuation properties as compared to conventional concrete floors.

As noted above, the underside of the self-supporting insulated deck structure 10 includes fire retardant board 12 which is preferably gypsum board. This provides a smooth, flat surface which increases the light reflection and overall illumination in the building. The underside of the fire retardant board 12 may be left exposed or may be painted. If a more finished ceiling is desired, finished ceiling material 30 can be secured directly to at least one of the pair of generally horizontally extending portions 15 of the support brackets 14. Thus, the generally horizontally extending portions 15 of the support brackets 14 eliminate the need for furring materials. The finished ceiling material may preferably be conventional gypsum drywall.

In the drawings and the specification, there has been set forth preferred embodiments of the invention and, although specific terms are employed, the terms are used in a generic and descriptive sense only and not for purpose of limitation, the scope of the invention being set forth in the following claims.

That which is claimed is:

1. An insulated deck structure for buildings, comprising:

a self-supporting slab formed of a cementitious material and having a substantially planar upper surface and a lower surface, said lower surface defining a plurality of downwardly depending beam members extending in parallel directions and a plurality of recessed surfaces therebetween, said beam members being dimensioned to be sufficiently self-supporting to provide structural strength sufficient to support said deck structure and design loads placed thereon;

a foam insulation member positioned between each adjacent pair of bean members and adjacent to the respective recessed surface;

a fire retardant board provided below each of said foam insulation members; and a support bracket affixed to a downward end of each of said beam members, said support bracket having an upwardly extending portion secured within said beam member and a pair of generally horizontally extending portions for supporting said fire retardant board and said foam insulation member, said support bracket providing negligible structural support.

2. A deck structure as defined in claim 1 wherein said recessed surfaces between said beam members are substantially planar and horizontal and said foam insulation members have planar and horizontal upper surfaces corresponding to said recessed surfaces.

3. A deck structure as defined in claim 2 wherein said upwardly extending portion of each of said support brackets extends upwardly into said beam member to a horizontal level below said upper surface of said foam insulation member.

4. A deck structure as defined in claim 1 further comprising at least one horizontal reinforcing member extending through each of said beam members and being spaced from the respective support bracket.

5. A deck structure as defined in claim 1 further comprising:

first and second horizontal reinforcing members extending through each of said beam members, said first horizontal reinforcing member being in close proximity to the upper end of said upwardly extending portion of the respective support bracket, said second horizontal reinforcing member being spaced a distance above said first horizontal reinforcing member; and a plurality of vertical reinforcing members extending upwardly within each of said beam members and connected to said first and second horizontal reinforcing members.

6. A deck structure as defined in claim 5 wherein said vertical reinforcing members extend upwardly a distance beyond said second horizontal reinforcing member;

said deck structure further comprising third and fourth horizontal reinforcing members extending through each of said beam members, said third and fourth horizontal reinforcing members being connected to said vertical reinforcing members a distance above said second horizontal reinforcing member;

at least one lateral support member being connected to said third and fourth horizontal reinforcing members and extending laterally between and supported by adjacent foam insulation members.

7. A deck structure as defined in claim 1 further comprising a reinforcing wire mesh embedded in said slab below said substantially planar upper surface.

8. A deck structure as defined in claim 1 further comprising a sound attenuating board provided below each of said foam insulation members and supported on said pair of generally horizontally extending portions of said support brackets.

9. A deck structure as defined in claim 1 further comprising a finishing member connected to at least one of said horizontally extending portions of said support brackets.

10. An insulated deck structure for buildings, comprising:

a slab formed of a cementitious material and having a substantially planar upper surface and a lower surface, said lower surface defining a plurality of downwardly depending beam members extending in parallel directions and a plurality of recessed surfaces therebetween, said beam members having a predetermined depth extending between said recessed surfaces and a downward end of each beam member and being otherwise dimensioned to provide structural strength sufficient to support said deck structure and design loads placed thereon;

a foam insulation member positioned between each adjacent pair of beam members and adjacent to the respective recessed surface;

a fire retardant board provided below each of said foam insulation members; and a support bracket affixed to the downward end of each of said beam members, said support bracket having an upwardly extending portion secured within said beam member and a pair of generally horizontally extending portions for supporting said fire retardant board and said foam insulation member, said upwardly extending portion extending into the downward end of said beam member by a distance less than the depth of said beam member.

11. A deck structure as defined in claim 10 wherein said upwardly extending portions of said support brackets extend into the downward end of the respective beam member by an amount less than half of the depth of said beam member.

12. A deck structure as defined in claim 10 wherein said recessed surfaces between said beam members are substantially planar and horizontal and said foam insulation members have planar and horizontal upper surfaces corresponding to said recessed surfaces.

13. A deck structure as defined in claim 12 wherein said upwardly extending portion of each of said support brackets extends upwardly into said beam member to a horizontal level below said upper surface of said foam insulation member.

14. A deck structure as defined in claim 10 further comprising at least one horizontal reinforcing member extending through each of said beam members and being spaced from the respective support bracket.

15. A deck structure as defined in claim 10 further comprising:

first and second horizontal reinforcing members extending through each of said beam members, said first horizontal reinforcing member being in close proximity to the upper end of said upwardly extending portion of each of the respective support bracket, said second horizontal reinforcing member being spaced a distance above said first horizontal reinforcing member; and a plurality of vertical reinforcing members extending upwardly within each of said beam members and connected to said first and second horizontal reinforcing members.

16. A deck structure as defined in claim 15 wherein said vertical reinforcing members extend upwardly a distance beyond said second horizontal reinforcing member;

said deck structure further comprising third and fourth horizontal reinforcing members extending through each of said beam members, said third and fourth horizontal reinforcing members being connected to said vertical reinforcing members a distance above said horizontal reinforcing member;

at least one lateral support member being connected to said third and fourth horizontal reinforcing members and extending laterally between and supported by adjacent foam insulation members.

17. A deck structure as defined in claim 10 further comprising a reinforcing wire mesh embedded in said slab below said substantially planar upper surface.

18. A deck structure as defined in claim 10 further comprising a sound attenuating board provided below each of said foam insulation members and supported on said pair of generally horizontally extending portions of said support brackets.

19. A deck structure as defined in claim 10 further comprising a finishing member connected to at least of one of said horizontally extending portions of said support brackets.

20. A method of forming an insulated deck structure comprising the steps of:

providing a pair of spaced end supports for supporting the deck structure;

extending a plurality of support brackets in parallel directions between the end supports;

shoring the support brackets from below to provide reinforcement;

securing a fire retardant board to a foam insulation member;

placing the laminated fire retardant board and foam insulated member between an adjacent pair of support brackets so that the firs retardant board is supported on the support brackets;

pouring a substantially liquid cementitious material over the support brackets and foam insulation member to a predetermined height above the foam insulation member;

allowing the cementitious material to dry and harden such that the cementitious material can support the weight of the deck structure; and then removing the shoring.

21. A method of forming an insulated deck structure as defined in claim 20 further comprising the step of extending a horizontal reinforcing member between said foam insulation members before said pouring step so that the substantially liquid cementitious material is also poured over the reinforcing member.

22. A method of forming an insulated deck structure as defined in claim 20 further comprising the steps of:

positioning a plurality of vertical reinforcing members parallel to one another, each of the vertical reinforcing members having an upper and a lower end;

positioning a first horizontal reinforcing member and a second horizontal reinforcing member in close proximity to the lower end of the vertical reinforcing members such that the second horizontal reinforcing member is above and generally parallel to the first horizontal reinforcing member;

securing the vertical reinforcing members to the first and the second horizontal reinforcing members; and positioning the vertical reinforcing members and the first and the second horizontal reinforcing members over the support bracket before said pouring step such that the lower ends of the vertical reinforcing members are adjacent to the support bracket and the substantially liquid cementitious material is also poured over the first and the second horizontal reinforcing members and the vertical reinforcing members.

23. A method of forming an insulated deck structure as defined in claim 22 further comprising the steps of:

positioning third and fourth horizontal reinforcing members in close proximity to and on opposite sides of the upper ends of the vertical reinforcing members;

securing third and the fourth horizontal reinforcing members to the vertical reinforcing members;

positioning a lateral support member on adjacent foam insulation members and underneath the third and the fourth horizontal reinforcing members; and securing the lateral support member to the third and the fourth horizontal reinforcing members before said pouring step so that the substantially liquid cementitious material is also poured over the third and fourth horizontal reinforcing members and the lateral support member.

24. A method of forming an insulated deck structure as defined in claim 20 further comprising the step of positioning a reinforcing wire mesh over the foam insulation members before said pouring step.

25. A method of forming an insulated deck structure as defined in claim 20 further comprising the steps of:

securing a finishing member to the support brackets; and applying a finishing surface to the exposed surface of the finishing member.

* * * * *

UNITED STATES PATENT AND TRADEMARK OFFICE
CERTIFICATE OF CORRECTION

PATENT NO. : 5,930,965

DATED : August 3, 1999

INVENTOR(S) : Carver

It is certified that error appears in the above-identified patent and that said Letters Patent is hereby corrected as shown below:

Column 7, line 32, "bean" should read --beam--.

Column 9, line 55, "firs" should read --fire--.

Signed and Sealed this

Eleventh Day of January, 2000

*Attest:*

Q. TODD DICKINSON

*Attesting Officer*

*Acting Commissioner of Patents and Trademarks*